US007234773B2

(12) United States Patent
Raftery et al.

(10) Patent No.: US 7,234,773 B2
(45) Date of Patent: Jun. 26, 2007

(54) BACKREST FOR A CHAIR, WITH A RETRACTOR

(75) Inventors: William Raftery, Canton, OH (US); Paul Meyers, Fishers, IN (US); John Heyder, Orleans, IN (US)

(73) Assignee: HNI Technologies Inc., Muscatine, IA (US)

( * ) Notice: Subject to any disclaimer, the term of this patent is extended or adjusted under 35 U.S.C. 154(b) by 8 days.

(21) Appl. No.: 11/153,761

(22) Filed: Jun. 14, 2005

(65) Prior Publication Data

US 2006/0001303 A1 Jan. 5, 2006

Related U.S. Application Data

(60) Provisional application No. 60/579,437, filed on Jun. 14, 2004.

(51) Int. Cl.
*A47C 7/46* (2006.01)
*A47C 7/14* (2006.01)

(52) U.S. Cl. ..... 297/284.4; 297/452.18; 297/452.3

(58) Field of Classification Search ..... 297/284.4, 297/452.18, 452.3, 452.13, 452.56
See application file for complete search history.

(56) References Cited

U.S. PATENT DOCUMENTS

| | | | | |
|---|---|---|---|---|
| D273,916 | S | 5/1984 | Murry | |
| D346,279 | S | 4/1994 | Stumpf et al. | |
| D386,023 | S | 11/1997 | Stumpf et al. | |
| D391,424 | S | 3/1998 | Raftery | |
| D406,475 | S | 3/1999 | Shovlowsky | |
| D407,911 | S | 4/1999 | Brauning | |
| 5,988,746 | A | 11/1999 | Raftery | |
| D418,316 | S | 1/2000 | Vogtherr | |
| D420,523 | S | 2/2000 | Stumpf et al. | |
| D422,806 | S | 4/2000 | Neil | |
| D423,259 | S | 4/2000 | Grove | |
| D431,400 | S | 10/2000 | Grove | |
| D440,419 | S | 4/2001 | Roder | |
| D445,581 | S | 7/2001 | Su | |
| 6,257,665 | B1 | 7/2001 | Nagamitsu et al. | |
| D446,955 | S | 8/2001 | Zemp | |
| D449,174 | S | 10/2001 | Neil | |
| D451,293 | S | 12/2001 | Su | |
| D453,079 | S | 1/2002 | Ma | |
| 6,354,662 | B1 * | 3/2002 | Su | 297/284.7 |
| D456,626 | S | 5/2002 | Su | |

(Continued)

OTHER PUBLICATIONS

JDS International, Special NeoCon 2000 brochure, Chair as marked, Executive Chairs.

*Primary Examiner*—David R. Dunn
*Assistant Examiner*—Tania Abraham
(74) *Attorney, Agent, or Firm*—Faegre & Benson LLP

(57) ABSTRACT

A chair having a backrest with a Y-shaped member. The member being affixed to the center of the top rail of the backrest frame at one end. The other end of the Y-shaped member connects to backrest fabric, pulls it rearward, and holds the backrest fabric in tension using a pair of retractors. The backrest fabric is secured to the retractors by a welt cord contained within a chamber formed in each retractor. The welt cord is sewn into a fabric sheath that is, in turn, stitched to the backrest fabric. The member is biased to flex rearward when the backrest fabric moves rearward from an at-rest position.

17 Claims, 7 Drawing Sheets

U.S. PATENT DOCUMENTS 6,386,634 B1 5/2002 Stumpf et al.
6,523,898 B1 2/2003 Ball et al.
6,572,190 B2 * 6/2003 Koepke et al. ..... 297/284.1
6,698,833 B2 * 3/2004 Ball et al. ..... 297/284.7
6,848,744 B1 * 2/2005 Raftery et al. ..... 297/284.1
D507,134 S * 7/2005 Raftery ..... D6/502
7,025,424 B2 * 4/2006 Harley ..... 297/452.63
2005/0104428 A1 * 5/2005 Walker et al. ..... 297/284.4

* cited by examiner

BACKREST FOR A CHAIR, WITH A RETRACTOR

CROSS REFERENCE TO RELATED APPLICATIONS

This application claims the benefit of U.S. provisional patent application No. 60/579,437, filed Jun. 14, 2004 (now expired).

BACKGROUND OF THE INVENTION

The invention relates generally to chairs, and more particularly to a retractor structure for a chair backrest and a height-adjustable chair arm.

BRIEF DESCRIPTION OF THE DRAWINGS

The present invention will hereinafter be described in conjunction with the appended drawing figures wherein like numerals denote like elements.

DETAILED DESCRIPTION OF THE PREFERRED EMBODIMENTS

Figure 1:
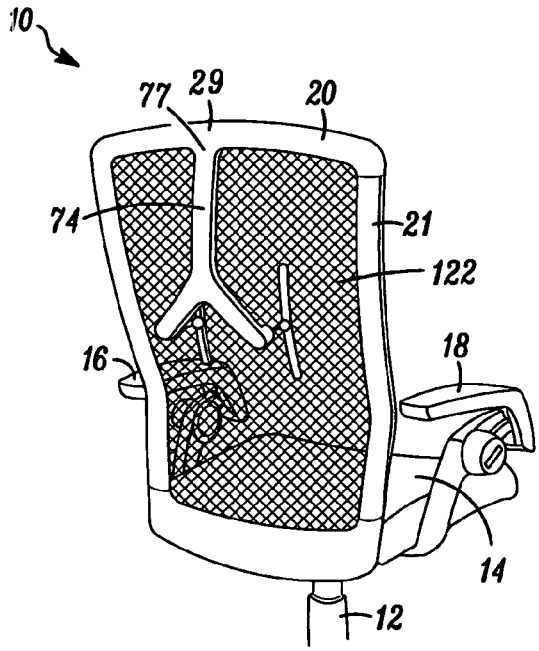
FIG. 1 is a perspective view of a chair showing the backrest and adjustable arm of the present invention.

The ensuing detailed description provides preferred exemplary embodiments only, and is not intended to limit the scope, applicability, or configuration of the invention. Rather, the ensuing detailed description of the preferred exemplary embodiments will provide those skilled in the art with an enabling description for implementing the preferred exemplary embodiments of the invention. It being understood that various changes may be made in the function and arrangement of elements without departing from the spirit and scope of the invention, as set forth in the appended claims.

To aid in describing the invention, directional terms are used in the specification and claims to describe portions of the chair 10 of the present invention (e.g., upper, lower, left, right, etc.). These directional definitions are merely intended to assist in describing and claiming the invention and are not intended to limit the invention in any way. In addition, reference numerals that are introduced in the specification in association with a drawing figure may be repeated in one or more subsequent figures without additional description in the specification in order to provide context for other features.

FIG. 1 shows a preferred embodiment of the chair 10 of the present invention, which includes a base 12, a seat 14, left and right arms 16, 18 and a backrest 20. The base 12 and seat 14 are conventional. The backrest 20 defines an opening that is covered by a backrest fabric 122, which is preferably an expanded mesh material that is see-through. It should be understood that any features described in relation to the right arm 18 are also present as a mirror image in the left arm 16 and vice-versa.

Figure 2:
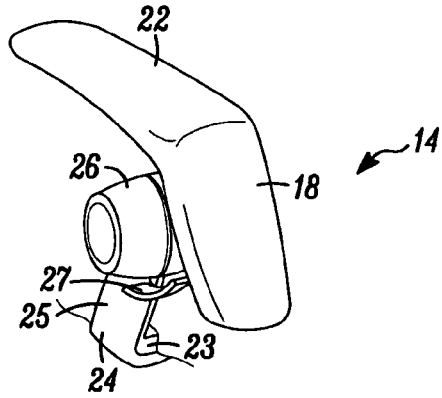
FIG. 2 is an enlarged perspective view of the right arm.
Figure 3:
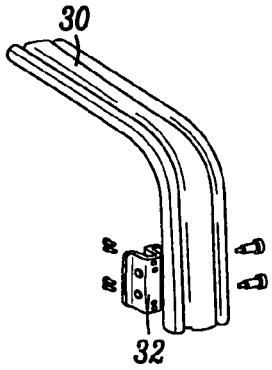
FIG. 3 is an enlarged perspective view of the armrest frame for the right arm.

Referring now to FIG. 2, the right arm 18 includes an armrest 22 and an arm support 24, which is connected to the armrest 22 by a height-adjustment structure 26. As will be discussed in greater detail herein, the armrest 22 is height-adjustable relative to the seat 14. The armrest support 24 includes a lateral portion 23 that is rigidly affixed to the base 16 and an upright portion 25 that extends upwardly from the lateral portion 23. Rigidity for the armrest 22 is provided by an armrest frame 30 (see FIG. 3), which is connected to the height-adjustment structure 26 via a bracket 32.

Figure 4:
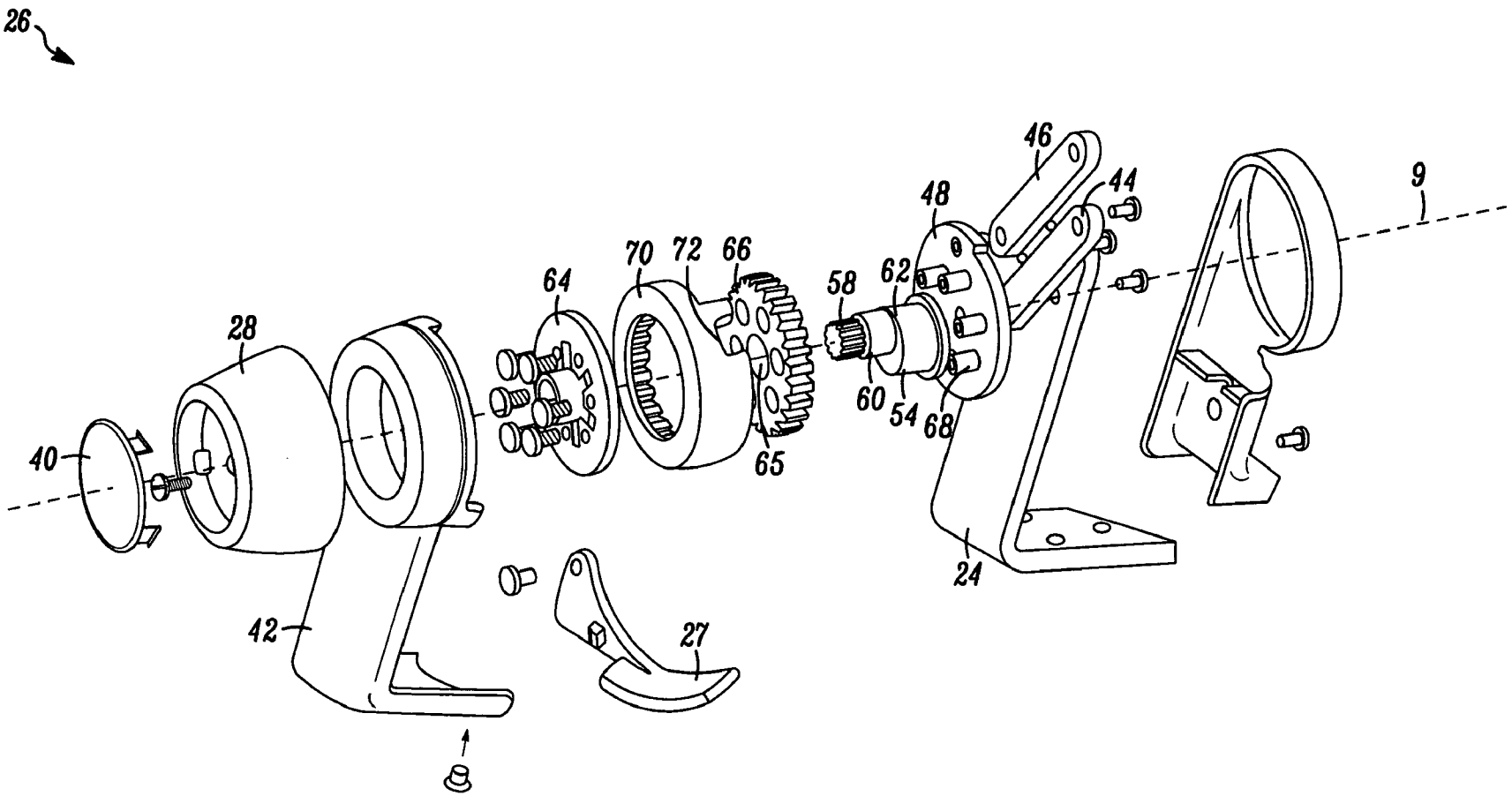
FIG. 4 is an exploded view, taken from the right-front side, of the right arm.
Figure 5:
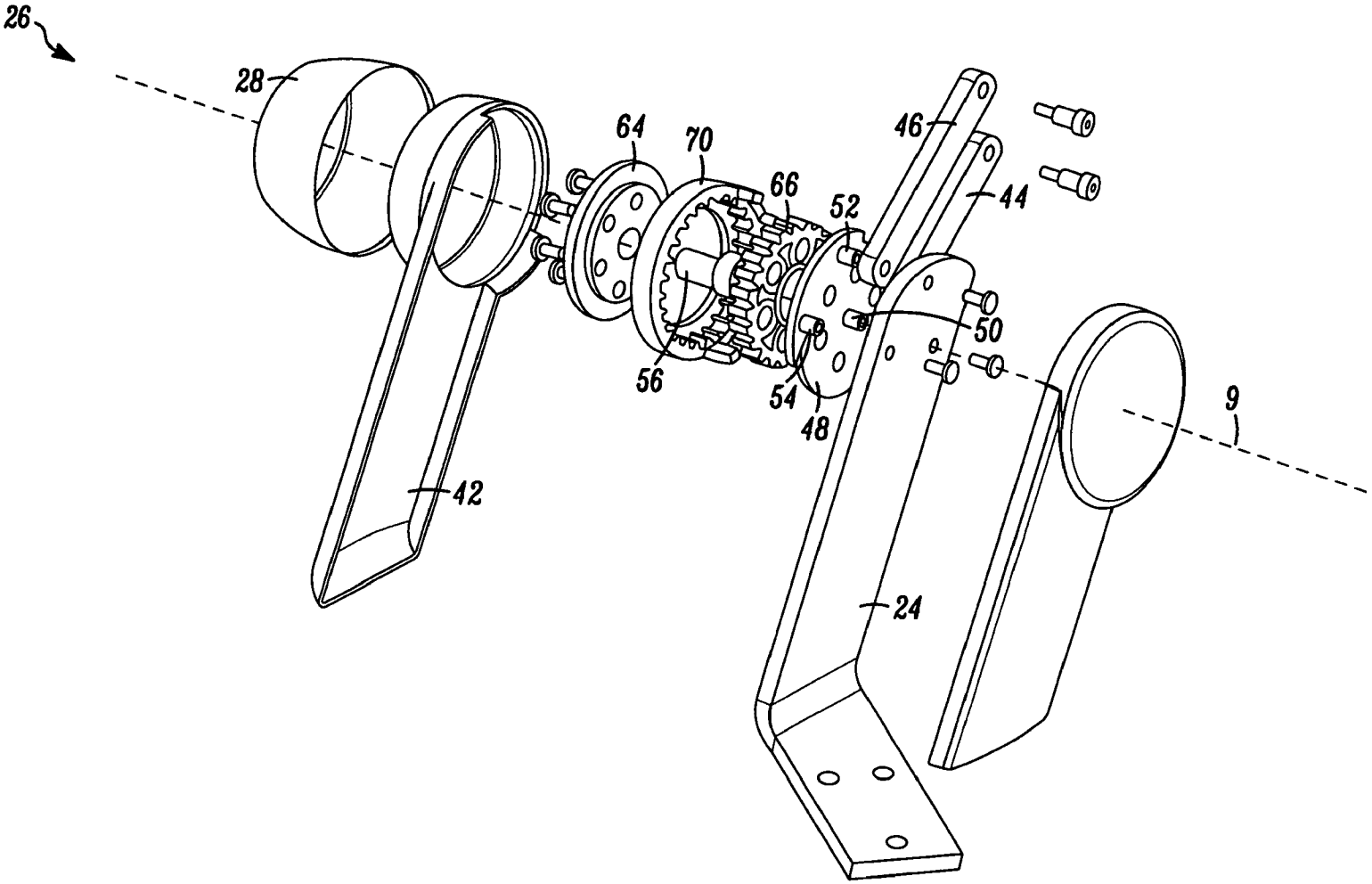
FIG. 5 is an exploded view, taken from the right-rear side, of the left arm.

Referring now to FIGS. 4 and 5, the height-adjustment structure 26 will be described in detail. The armrest 22 is connected to the support 24 by two linkages 44, 46. The linkages 44, 46 pivot relative to the support 24 and the armrest frame bracket 32 (see FIG. 3), so that the armrest maintains a substantially level (i.e., remains in substantially the same rotational orientation) as the linkages 44, 46 move the armrest 22 up and down through the armrest's 22 range of motion. In this embodiment, the linkages 44, 46 are of equal length and are arranged to remain parallel when pivoting. Linkage 44 will be referred to herein as the drive linkage 44 and linkage 46 will be referred to herein as the non-drive linkage 46. This portion of the height-adjustment structure 26 is sometimes referred to in the art as a four-bar linkage.

The linkages 44, 46 are sandwiched between a boss plate 48 and the support 24 and are pivotally attached to the boss plate 48 by linkage posts 50, 52 located on the inner side of the boss plate 48. The linkage post 50 for the drive linkage 44 is preferably located along a central axis 9 of the height-adjustment structure 26 and the linkage post 52 for the non-drive linkage 46 is located above the linkage post 50 for the drive linkage 44 and vertically aligned therewith. A third post 54 is included to provide stability. Each of the three posts 50, 52, 54 is aligned with a respective hole located in the support 24 and is secured to the support 24 with a screw or any other suitable fastener. The outer diameter of each of the linkage posts 50, 52 is sized to allow a lower hole of the respective linkage 44, 46 to rotate about the post, while minimizing "play" in the linkage 44, 46. Similarly, the length of each of the posts 50, 52, 54 is sized to allow the linkages 44, 46 to rotate freely about the posts 50, 52, while minimizing "play" from side-to-side.

An eccentric shaft 56 is located on the outer side of the boss plate 48. Moving from the outside end to the inside end, the eccentric shaft 56 includes a gear 58 that engages a knob 28, a non-eccentric bearing surface 60 that rotates within a bearing plate 64, and an eccentric bearing surface 62 that rotates within an axial hole 65 of an inner gear 66. Both bearing surfaces 60, 62 are cylindrical in shape. The non-eccentric bearing surface 60 is centered about the central axis 9 and the eccentric bearing surface 62 is off-center from the central axis 9. In this embodiment, the eccentric bearing surface 62 is off-center by about 0.070 inches.

Six posts 68 extend outwardly from the boss plate 48. Each of the six posts 68 is located along a circular path and is evenly-spaced along the path. Both the bearing plate 64 and the inner gear 66 include six holes formed therein that are positioned and spaced to slide over the six posts 68 in the boss plate 48 so that the bearing plate 64 and the inner gear 66 cannot rotate relative to the boss plate 48. Each of the six holes located in the inner gear 66 is 0.070 inches larger in radius than each of the posts 68 to allow lateral movement of the inner gear when the eccentric shaft 56 is rotated. In this embodiment, lateral movement of the inner gear 66 follows a circular path as the eccentric shaft 56 is rotated. An outer gear 70 is sandwiched between the bearing plate 64 and the boss plate 48.

Figure 6:
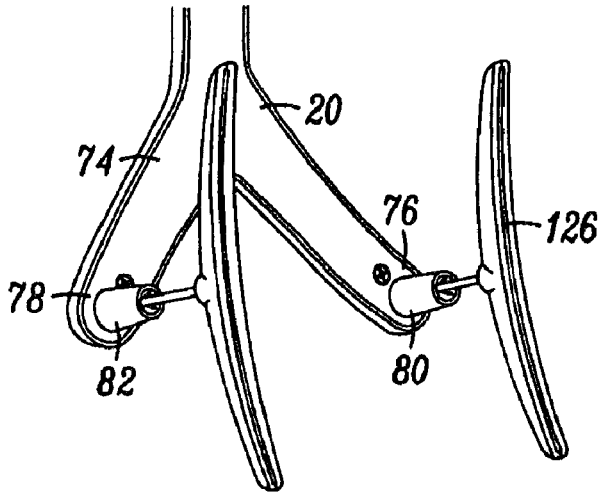
FIG. 6 is a partial view of the lower portion of the retractor structure of the backrest.

Referring now to FIGS. 1 and 6, the backrest 20 will be described in greater detail. The backrest 20 includes a top rail 29 having an inverted Y-shaped member 74 that is attached to the top rail 29 at an upper end 77 and terminates at two lower ends 76, 78. A retractor 80, 82 is located on the inner side of each of the lower ends 76, 78. The left and right retractors 80, 82 work in conjunction with the Y-shaped member 74 to pull the backrest fabric (the fabric against which rests the back of a person sifting in the chair) rearward along two seams. As will be explained herein, the retractor 80, 82 places the backrest fabric under tension, which provides a firm, comfortable surface for the user. In addition, the retractor 80, 82 is designed to "give", which adds to the comfort of the user. The Y-shaped member 74 may also flex slightly to provide additional "give" to the backrest fabric.

When the eccentric shaft 56 is rotated a full revolution (i.e., 360 degrees), the eccentric bearing surface 62 moves the inner gear 66 through one cycle of lateral movement, which causes the outer gear to rotate the width of one tooth (about fifteen degrees in this embodiment). The outer gear 70 includes a slot 72 that engages the drive linkage 44. Thus, rotation of the outer gear 70 causes the drive linkage 44 to rotate in the same direction. This structure also provides a mechanical advantage between rotation of the knob 28 and change in height of the armrest 22.

As noted above, the larger relative size of the post-engaging holes of the inner gear 66 allows lateral movement of the inner gear 66 relative to the outer posts 68 of the boss plate 48. The magnitude of the difference in radius between the post-engaging holes of the inner 66 and the outer posts 68 of the boss plate is equal to the offset of the eccentric bearing surface 62 and is equal to 50–55% of the tooth depth of the inner gear 66. This enables sufficient lateral movement of the inner gear 66 to allow the teeth of the inner gear 66 to engage and disengage the teeth of the outer gear 70 as the eccentric shaft 56 is rotated. In addition, it ensures that at least one of the outer posts 68 will be engaged with the wall of the post-engaging hole located therein. This minimizes rotation of the inner gear 66 and enables the inner gear 66 "bind", which prevents rotation of the outer gear 70 when the eccentric shaft 56 is not being rotated by the knob 28. Covers 40 and 42 shroud and protect the mechanical components of the height adjustment structure 26.

Figure 7:
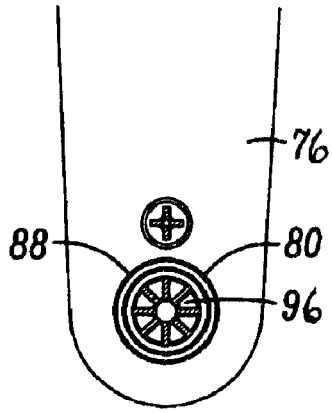
FIG. 7 is an enlarged front partial view of the barrel portion of the retractor structure.
Figure 8:
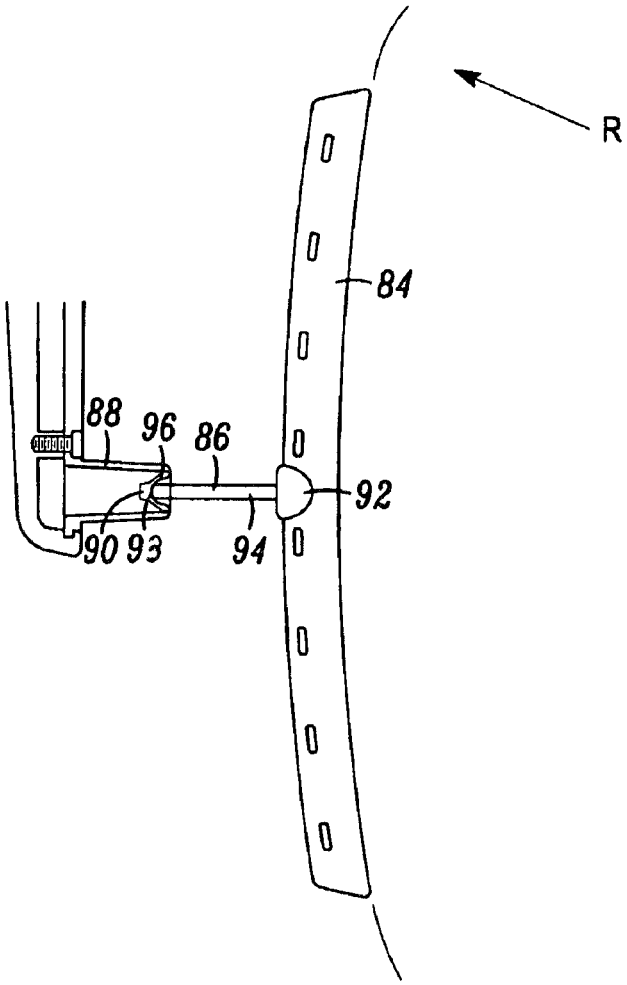
FIG. 8 is a sectional view of the retractor structure shown in an extended position (in tension).
Figure 9:
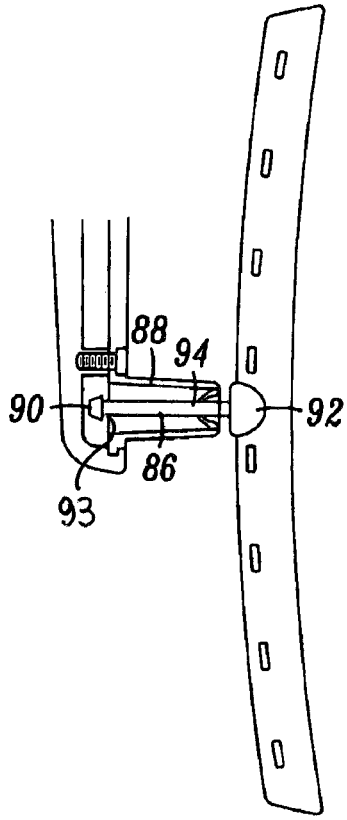
FIG. 9 is a sectional view of the retractor structure shown in a retracted position (tension relieved).

Referring now to FIGS. 8 and 9, one can see that the pull 84 is slender and elongated. The inner edge of the pull 84 has a slight concave curvature of radius R, where R is between 20 and 30 inches, preferably 24 inches. This curvature is intended to more closely follow the natural curvature of the user's back, and therefore, make the backrest 20 more comfortable. The plunger 86 is affixed to the outer surface of the pull 84, preferably midway between the top and bottom of the pull 84. The plunger 86 includes a base 92 which engages the pull 84, a slender, cylindrical body 94 and a tapered head 90 that is designed to be inserted through a radial array of fingers 96 (see also FIG. 7). The fingers 96 flex outwardly as the head 90 is pushed through, then return to their original position. A lip 93 that defines the transition between the head 90 and the body 94 prevents the head 90 from being pulled back through the fingers 96.

Most of the components of the height adjustment structure 26 are formed of metal or a durable, rigid polymer. Smooth and reliable operation has been achieved by forming the bearing plate 64, inner gear 58 and outer gear 60 from nylon, Delrin® brand plastic, manufactured by E. I. DuPont Nemours and Company, or other rigid, non-binding polymers.

Referring now to FIGS. 1 and 6, the backrest 20 will be described in greater detail. The backrest 20 includes a top rail 29 having an inverted Y-shaped member 74 that is attached to the top rail 29 at an upper end 77 and terminates at two lower ends 76, 78. A retractor 80, 82 is located on the inner side of each of the lower ends 76, 78. The left and right retractors 80, 82 work in conjunction with the Y-shaped member 74 to pull the backrest fabric 122 (the fabric against which rests the back of a person sitting in the chair) rearward along two seams. As will be explained herein, the retractor 80, 82 places the backrest fabric 122 under tension, which provides a firm, comfortable surface for the user. In addition, the retractor 74 is designed to "give", which adds to the comfort of the user. The Y-shaped member 74 may also flex slightly to provide additional "give" to the backrest fabric 122.

In the context of the parts of the backrest 20, including backrest fabric 122, the Y-shaped member 74 and the retractors 80,82, the terms "front," "frontward" or "front side" are intended to refer to the side of any of these parts which faces a person sitting in the chair. Conversely, the terms "rear," "rearward" or "rear side" are intended to refer to the side of any of the parts of the backrest 20 opposite the front side (i.e., facing way from a person sitting in the chair).

The left and right retractors 80, 82 are mirror-images of each-other. It should be understood that any features described in relation to the left retractor 80 are also present as a mirror image in the right retractor 82 and vice-versa. The retractor 80 includes a pull 84, a plunger 86 and a barrel 88.

Referring now to FIGS. 8 and 9, one can see that the pull 84 is slender and elongated. The inner edge of the pull 84 has a slight concave curvature of radius R, where R is between 20 and 30 inches, preferably 24 inches. This curvature is intended to more closely follow the natural curvature of the user's back, and therefore, make the backrest 20 more comfortable. The plunger 86 is affixed to the outer surface of the pull 84, preferably midway between the top and bottom of the pull 84. The plunger 86 includes a base 92 which engages the pull 84, a slender, cylindrical body 94 and a tapered head 90 that is designed to be inserted through a radial array of fingers 96 (see also FIG. 7). The fingers 96 flex outwardly as the head 90 is pushed through, then return to their original position. A lip 96 that defines the transition between the head 90 and the body 94 prevents the head 90 from being pulled back through the fingers 96.

Optionally, an opaque fabric member can be provided which is positioned in front of the backrest fabric 122. The opaque fabric member is preferably sewn to the backrest fabric 122 around its perimeter and along or near the seam 120 which attaches that backrest fabric 122 to the fabric sheath 116. The opaque member is designed to provide additional padding, and a more traditional appearance from the front side of the chair 10. The opaque fabric member could be formed from any conventional material, such as padded core sandwiched between layers of a polyester or polyester-blend material.

Figure 10:
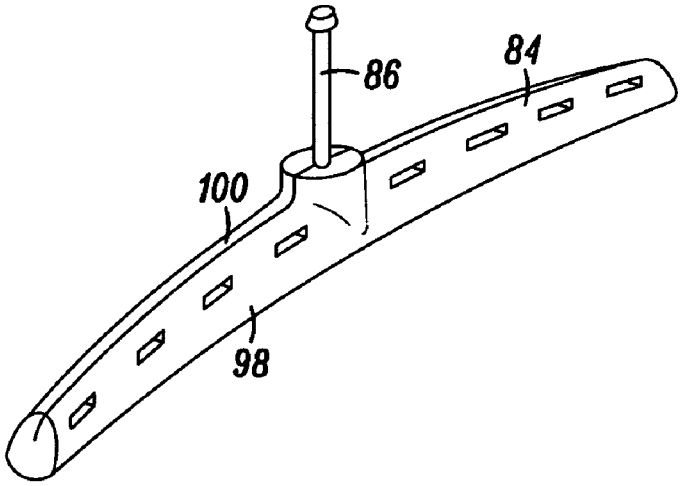
FIG. 10 is a perspective view of one assembled pull and plunger.
Figure 11:
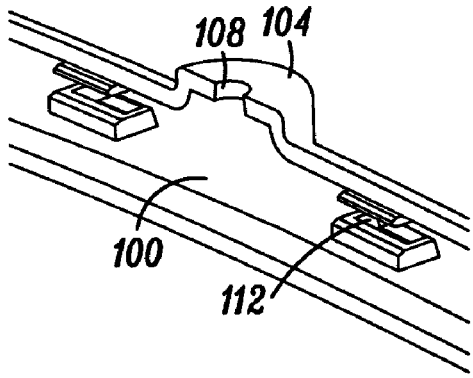
FIG. 11 is a partial sectional view of the male pull.
Figure 12:
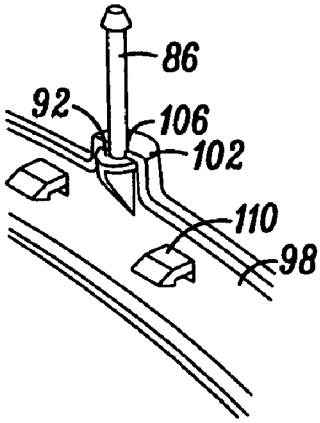
FIG. 12 is a partial sectional view of the female pull and plunger.

In this embodiment, the pull 84 is comprised of two halves: a male half 98 and a female half 100, as shown in FIGS. 10–12. Use of male and female halves 98, 100 simplifies assembly. The male and female halves 98, 100 include structures to retain the plunger 86, in this embodiment mating half-cylinders 102, 104 each having a centrally located half-circle 106, 108 are provided. Alternatively, the plunger 86 could be molded as part of one of the male and female halves 98, 100. In addition, the male and female halves 98, 100 include a fastening structure that prevents the halves 98, 100 from separating once assembled. In this embodiment latches 110 located along the male half 98 mate with locks 112 located along the female half 100. Any suitable fastening structure could be used, as could adhesives (either alone or as a supplement to the fasteners).

Figure 13:
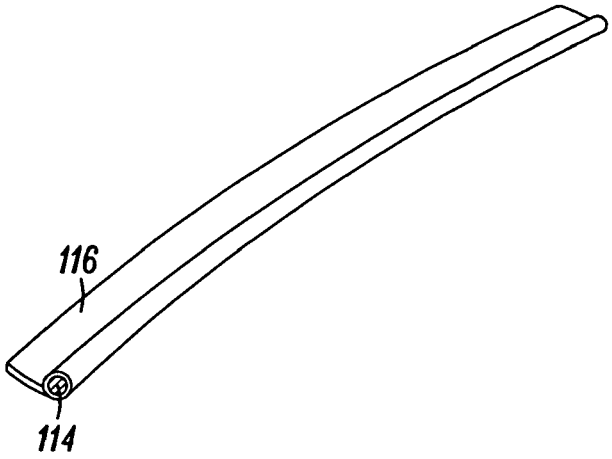
FIG. 13 is a perspective view of the welt cord and enveloping fabric.
Figure 14:
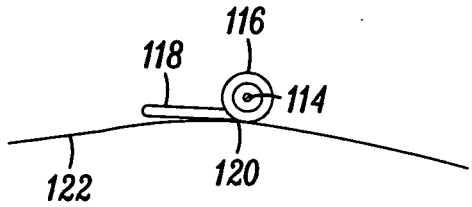
FIG. 14 is an end view showing the welt cord and fabric sheath with the fabric sheath is sewn to the backrest fabric.
Figure 15:
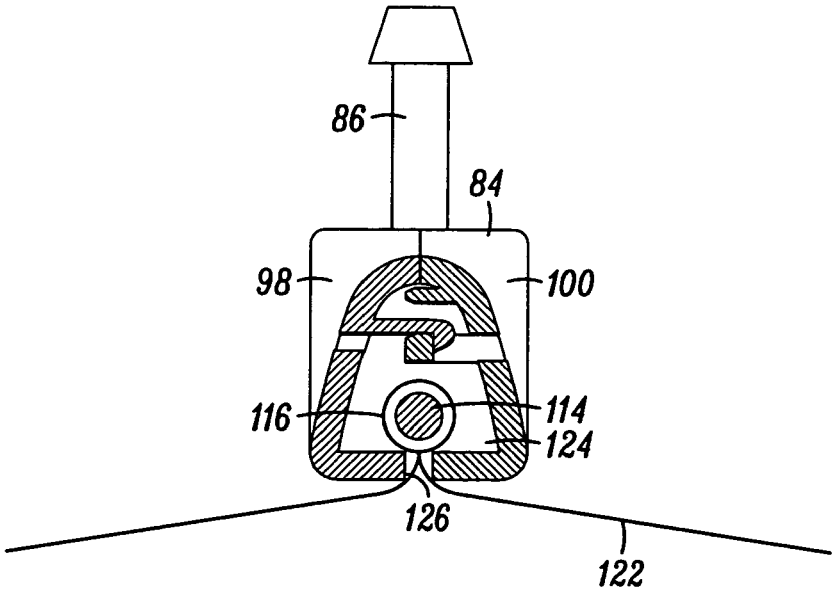
FIG. 15 is an end view showing the welt cord contained within the assembled male and female pulls.

Referring now to FIGS. 13–15, the structure for attaching the backrest fabric 122 to the retractor is shown. A fabric sheath 116 is sewn around a welt cord 114, leaving a flap 118 of excess fabric. The welt cord 114 is preferably slightly shorter in length than the pull 84 and may optionally have the same curvature (or radius R) as the inner surface of the pull 84. The welt cord 114 is preferably formed of a polymeric material that will provide some longitudinal flexibility, but strong cross-sectional rigidity. The fabric sheath 116 is preferably a durable fabric having a dense weave.

The fabric sheath 116 is sewn to backrest fabric 122 along a seam 120 that is located where the welt cord 114 and fabric flap 118 meet. After the backrest fabric 122 is sewn to the fabric sheath 116, the welt cord 114 and fabric sheath 116 are enclosed within a chamber 124 formed within the pull 84. Preferably, the welt cord 114 is drawn into the chamber 124 sufficiently far so that the seam 120 cannot be felt by the user.

When being assembled, the welt cord 114 and fabric sheath 116 are inserted into the chamber 124, then the male and female halves 98, 100 are assembled. An elongated slot 126 (see also FIG. 6) allows the male and female halves 98, 100 to be more easily assembled and prevents pinching of the backrest fabric 122.

Optionally, an opaque fabric member can be provided which is positioned in front of the backrest fabric 122. The opaque fabric member is preferably sewn to the backrest fabric 122 around its perimeter and along or near the seam 120 which attaches that backrest fabric 122 to the fabric sheath 116. The opaque member is designed to provide additional padding, and a more traditional appearance from the font side of the chair 10. The opaque fabric member could be formed from any conventional material, such as padded core sandwiched between layers of a polyester or polyester-blend material.

While the principles of the invention have been described above in connection with preferred embodiments, it is to be clearly understood that this description is made only by way of example and not as a limitation of the scope of the invention.

The invention claimed is:

1. A backrest for a chair, the backrest comprising:

a backrest frame that defines an opening, the backrest frame including a top rail;

a backrest fabric that is attached to the backrest frame and covers the opening; and a member having a first end that is attached to the backrest frame at the top rail and a second end that is distal to the first end and is connected to the backrest fabric, the member being biased to pull the backrest fabric rearward so that the backrest fabric is in tension when in an at-rest position, the member also being biased to flex rearward when the backrest fabric is moved rearward relative to the at-rest position.

2. The backrest of claim 1, wherein the member comprises a Y-shaped member.

3. The backrest of claim 1, wherein the backrest further comprises a retractor attached to the second end of the member and the backrest fabric is secured to the retractor.

4. The backrest of claim 3, wherein the backrest fabric is secured to the retractor by a welt cord contained within a fabric sheath that is attached to the backrest fabric, the welt cord being retained within a chamber located in the retractor.

5. The backrest of claim 3, wherein the retractor is elongated and includes a concave surface that contacts a rear side of the backrest fabric.

6. The backrest of claim 1, wherein the backrest fabric comprises an expanded mesh.

7. The backrest of claim 1, further comprising an opaque fabric positioned on the front side of the backrest fabric.

8. The backrest of claim 1, wherein the second end of the member is biased to move rearward when the backrest fabric is moved rearward from the at-rest position.

9. A chair comprising:

a seat;

a base;

a backrest frame, the backrest frame defining an opening and including a top rail;

a backrest fabric that is attached to the backrest frame and covers at least a portion of the opening; and a member having a first end that is attached to the backrest frame at the top rail and a second end that is distal to the first end and is connected to the backrest fabric, the member being biased to pull the fabric rearward so that the backrest fabric is in tension when in an at-rest position, the member being biased to flex rearward when the backrest fabric is moved rearward relative to the at-rest position.

10. The chair of claim 9, wherein the first end of the member is attached to the center of the top rail.

11. The chair of claim 9, wherein the member is a Y-shaped member having a third end that is distal to the first end and is connected to the backrest fabric.

12. The chair of claim 11, wherein the backrest frame comprises the top rail and the first end of the Y-shaped member is attached to the top rail.

13. A chair comprising:

a seat;

a base;

a backrest frame defining an opening, the backrest frame including a top rail;

a backrest fabric that covers at least a portion of the opening; and a Y-shaped member having a first end that is directly connected to the top rail of the backrest frame and second and third ends that are both distal to the first and are connected to the backrest fabric.

14. The chair of claim 13, wherein the Y-shaped member is attached to the center of the top rail.

15. The chair of claim 14, wherein the Y-shaped member further comprises a retractor attached to the second end of the member and the backrest fabric is secured to the retractor.

16. The backrest of claim 15, wherein the backrest fabric is secured to the retractor by a welt cord contained within a fabric sheath that is attached to the backrest fabric, the welt cord being retained within a chamber located in the retractor.

17. The backrest of claim 15, wherein the retractor is elongated and includes a concave surface that contacts a rear side of the backrest fabric.

* * * * *